US007712327B2

(12) United States Patent
Nelson et al.

(10) Patent No.: US 7,712,327 B2
(45) Date of Patent: May 11, 2010

(54) HEAT EXCHANGER AND METHOD FOR DEFROSTING A HEAT EXCHANGER

(75) Inventors: Bruce I. Nelson, Colville, WA (US); John L. Wold, Springdale, WA (US); Roger B. Williams, Colville, WA (US); Jeremy P. Olberding, Colville, WA (US)

(73) Assignee: Colmac Coil Manufacturing, Inc., Colville, WA (US)

( * ) Notice: Subject to any disclaimer, the term of this patent is extended or adjusted under 35 U.S.C. 154(b) by 323 days.

(21) Appl. No.: 11/725,689

(22) Filed: Mar. 19, 2007

(65) Prior Publication Data

US 2008/0229763 A1 Sep. 25, 2008

(51) Int. Cl.
*F25D 21/06* (2006.01)
*F28F 7/00* (2006.01)

(52) U.S. Cl. ..... 62/276; 62/275; 165/81; 165/82; 219/535

(58) Field of Classification Search ..... 62/275, 62/276; 165/81, 82; 219/535, 520, 2, 3, 219/522, 543
See application file for complete search history.

(56) References Cited

U.S. PATENT DOCUMENTS

| | | | | | |
|---|---|---|---|---|---|
| 153,776 | A | | 8/1874 | Mason | |
| 1,368,098 | A | | 2/1921 | Bates | |
| 2,025,456 | A | * | 12/1935 | Emil | 62/140 |
| 2,654,657 | A | * | 10/1953 | Reed | 422/204 |
| 2,707,703 | A | * | 5/1955 | Dorst | 205/138 |
| 2,755,371 | A | | 7/1956 | Jackson | |
| 2,930,207 | A | * | 3/1960 | Carl et al. | 62/276 |
| 3,002,729 | A | * | 10/1961 | Welsh | 165/183 |
| 3,091,680 | A | * | 5/1963 | Adrig | 219/200 |
| 3,263,747 | A | * | 8/1966 | Mckay | 165/76 |
| 3,286,079 | A | | 11/1966 | Hynes et al. | |
| 3,294,159 | A | * | 12/1966 | Kovalik et al. | 165/81 |
| 3,385,954 | A | * | 5/1968 | Rabinowitz et al. | 219/421 |
| 3,446,940 | A | | 5/1969 | Morgan | |
| 3,643,733 | A | | 2/1972 | Hall et al. | |
| 3,783,635 | A | * | 1/1974 | Perez | 62/276 |
| 3,974,022 | A | * | 8/1976 | Lauro | 159/13.3 |
| 4,186,725 | A | * | 2/1980 | Schwartz | 126/694 |
| 4,194,119 | A | | 3/1980 | MacKenzie | |
| 4,347,433 | A | * | 8/1982 | Wojtecki et al. | 219/535 |

(Continued)

FOREIGN PATENT DOCUMENTS

EP 99806 A2 * 2/1984

(Continued)

*Primary Examiner*—Frantz F Jules
*Assistant Examiner*—Alexis K Cox
(74) *Attorney, Agent, or Firm*—Wells St. John. P.S.

(57) ABSTRACT

A heat exchanger and method for defrosting a heat exchanger is disclosed and which includes a heat exchanger having a fluid receiving conduit, and at least one space which is defined, at least in part, by the fluid receiving conduit, an expandable and contractible heating element which is received within the space, and which is located in heat transmitting relation relative to the fluid receiving conduit, and a biasing member mounted on the heat exchanger and the heating element and which longitudinally, and resiliently restrains the movement of the heating element relative to the heat exchanger during the expansion and contraction of the heating element relative to the heat exchanger.

6 Claims, 6 Drawing Sheets

U.S. PATENT DOCUMENTS 4,485,998 A 12/1984 Kowalski et al.
4,766,736 A * 8/1988 Waldschmidt ..... 62/275
4,858,296 A * 8/1989 Gray ..... 29/890.044
5,010,738 A * 4/1991 Brown et al. ..... 62/135
5,117,482 A 5/1992 Hauber
5,507,339 A * 4/1996 Holbrook ..... 165/81
5,517,008 A * 5/1996 Francart, Jr. ..... 235/91 F
5,545,878 A * 8/1996 Jasper et al. ..... 219/541
5,549,078 A * 8/1996 Annecharico et al. ..... 392/398
6,626,004 B2 * 9/2003 Lee ..... 62/276
6,843,509 B2 1/2005 Nelson
6,929,067 B2 * 8/2005 Vinegar et al. ..... 166/302
7,592,572 B2 * 9/2009 Schlipf ..... 219/532

FOREIGN PATENT DOCUMENTS

JP 58210491 A * 12/1983

* cited by examiner 1
11
11
12
10
10
2A
20
10
12
10

11
11
12
13
14
20
26
21

HEAT EXCHANGER AND METHOD FOR DEFROSTING A HEAT EXCHANGER

TECHNICAL FIELD

The present invention relates to a heat exchanger and method for defrosting a heat exchanger, and more specifically to a novel mounting arrangement for electric resistance heating elements which are employed to defrost low temperature air-cooling heat exchangers.

BACKGROUND OF THE INVENTION

Air-cooling heat exchangers are used in a variety of residential, commercial and industrial refrigeration applications where temperatures of a space are maintained below the freezing point of water (32° F.). When operating at these lower temperatures and in many environments, frost or ice will accumulate on the fins and tube surfaces of the heat exchangers. The frost or ice must be periodically removed from these surfaces in order to maintain the efficiency of the cooling system.

One common method of defrosting heat exchangers involves inserting electric resistance heating elements into vacant spaces which are adjacent to a heat exchanger fin bundle. Thereafter, these heating elements are occasionally and periodically energized to warm the fin and tube surfaces to a temperature which is sufficient to melt the accumulated frost or ice. The resulting water is then captured and removed from the space which is being refrigerated. After all the fin and tube surfaces have been freed of the accumulated frost and ice, the heating elements are deenergized, and the heat exchanger is again used to reduce the refrigerated space to the desired temperature. This periodic heating and cooling of the fin and tube surfaces to render the frost and ice free is sometimes referred to as a "defrost cycle."

During a defrost cycle, melted frost or ice, in the form of liquid water, can sometimes make its way into the vacant tube spaces occupied by the heating element. As the heat exchanger begins to cool the refrigerated space after the defrost cycle, this liquid water conformally freezes and attaches, as ice, to the heating elements and to the sides of the vacant tube spaces in which the heating elements were placed. It should be understood that this same ice which forms around the heating element will temporarily anchor the heating element to the vacant tube spaces. Still further, and due to its coefficient of linear expansion, the metal sheath which typically encloses such heating elements will contract as the temperature of the heat exchanger drops. In the case of commercial and industrial heat exchangers, these heating elements can be as long as twenty feet or more. Consequently, the contraction which is experienced by these heating elements, when cooled, can be as much as one-half inch or more. When the heat exchanger is warmed during a subsequent defrost cycle, the same metal sheath of the heating element expands due the same coefficient of linear expansion. However, the ice that is anchoring the heating element to the vacant tube spaces does not immediately melt. Consequently, the resulting expansion of the heating element will cause it to move or creep outwardly from the heat exchanger tube bundle. Once the ice is dissipated, the heating element is left in an orientation where it is displaced outwardly relative to the heat exchanger by an amount which is equal to its linear expansion.

This movement of the heating element relative to the heat exchanger occurs, to some degree, during each defrost cycle. After repeated heating and cooling cycles, the heating element will essentially "creep" or "walk" out of the heat exchanger due to this repeated contraction and expansion. If this movement of the heating element remains unchecked, this relative movement of the heating elements may cause damage to the heating elements themselves, to the electrical wiring and circuits that feed the heating elements, or to neighboring equipment. To address this problem, a rigid mounting system was designed to restrain the heating element within the heat exchanger. It was discovered, however, that these mounting arrangements were often insufficient to counter the very strong forces resulting from the thermal expansion of the metal sheaths. More specifically, even if the chosen attachment device or method was strong enough, the repeated thermal expansion and contraction of the heating elements usually resulted in some internal damage to the heat exchanger tubes, fins, or casings.

A number of inventions have been disclosed which address the myriad of issues associated with the uneven expansion and contraction of components in heat exchanging devices, and which is caused by differences in temperatures of the component parts thereof. In U.S. Pat. No. 3,643,733 to Hall, for example, a spring is used to accommodate differences in expansion rates between tubes used to carry the different fluids in a fluid-to-fluid heat exchanger. Similar approaches have been used in cryogenic devices (U.S. Pat. No. 4,194,119 to MacKenzie) and fluid heaters (U.S. Pat. No. 5,117,482 to Hauber). None of these inventions, however, provide a solution to the problems associated with the expansion of an intermittently used heating element that is not directly involved with the normal heat exchange function.

Therefore, it has long been known that it would be desirable to provide a means of restraining electric resistance heating elements in such a way so as to accommodate limited movement of the heating elements during multiple defrost cycles while simultaneously preventing damage to the heating element and the associated heat exchanger. Further, it would be desirable to provide a means whereby the heating element could be returned to its proper position within the heat exchanger after each defrost cycle without causing damage to either the heating element itself, the heat exchanger, or associated equipment during their normal expected lifetime.

A novel mounting arrangement for electric resistance heating elements which avoids the shortcomings attendant with the prior art devices and practices utilized heretofore is the subject matter of the present application.

SUMMARY OF THE INVENTION

A first aspect of the present invention relates to a heat exchanger with a heating element which is positioned within a vacant space thereof, and which is further mounted in a resilient, longitudinally restrained orientation relative to the main body of the heat exchanger during the expansion or contraction of the heating element.

Another aspect of the present invention relates to a heat exchanger with a heating element and which further has a biasing member having a first end which is affixed to the first end of the heating element, and a second end which is affixed to a casing which encloses the heat exchanger.

Another aspect of the present invention relates to a heat exchanger which includes a casing which defines, at least in part, a vacant space; a fluid receiving conduit mounted on the casing and which defines, at least in part, the vacant space; a heat radiating fin mounted on the fluid receiving conduit, and extending outwardly relative thereto and into the vacant space; a heating element having a main body with opposite first and second ends, and wherein the main body is received within the vacant space, and disposed in juxtaposed, thermal transmitting relation relative to the fluid receiving conduit and heat radiating fin; and a biasing member having a first end which is affixed to the first end of the heating element, and a second end which is affixed to the casing.

Yet another aspect of the present invention relates to a heat exchanger with a casing defining at least one vacant space, and further including at least one aperture corresponding with the at least one vacant space; a plurality of fluid receiving conduits mounted on the casing; a plurality of heat radiating fins affixed to the plurality of fluid receiving conduits and extending substantially radially outwardly therefrom; a heating element having a main body with opposite first and second ends, and wherein the main body is received within the vacant space, and wherein the first end protrudes from the casing through the aperture, and wherein the heating element is disposed in juxtaposed, thermal transmitting relation relative to the fluid receiving conduit; and a flexing member with a first end, and an opposite second end; and wherein the first end of the flexing member is fixedly attached to the first end of the heating element, and wherein the second end of the flexing member is fixedly attached to the casing; and wherein the heating element is movable longitudinally relative to the vacant space to accommodate expansion and contraction of the heating element relative to the vacant space.

Still another aspect of the present invention relates to a method for defrosting an air cooling heat exchanger, and wherein the method includes the steps of providing a heating element; energizing the heating element to a temperature over 200° F., deenergizing the heating element; cooling the heat exchanger to a temperature below about 32° F.; and resiliently restraining the heating element relative to the casing so as to substantially oppose longitudinal movement of the heating element during the energizing and deenergizing of the heating element.

These and other aspects of the present invention will be described in greater detail hereinafter.

BRIEF DESCRIPTION OF THE DRAWINGS

Preferred embodiments of the invention are described below with reference to the following accompanying drawings.

FIG. 7 is a perspective view of one form of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
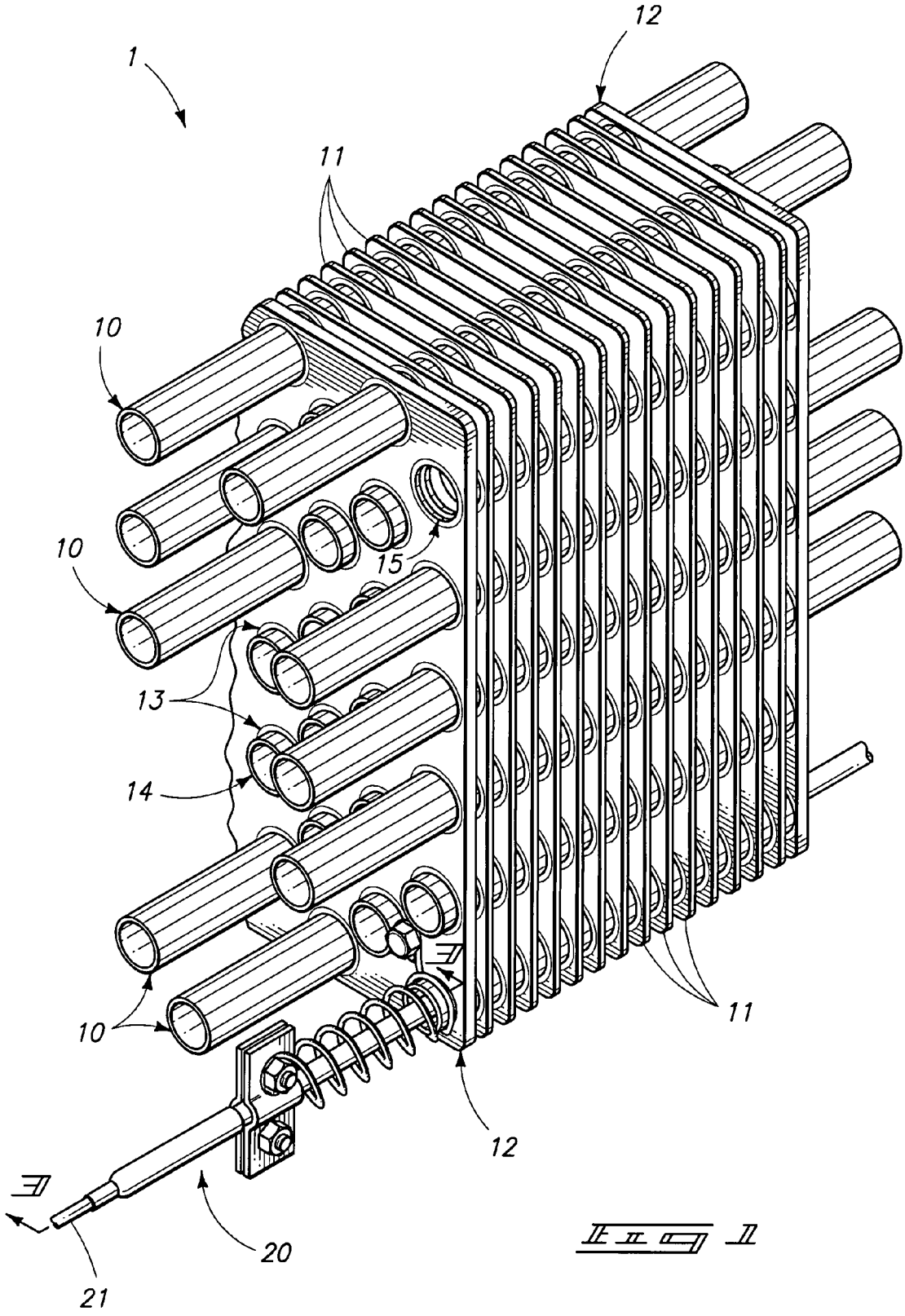
FIG. 1 is a perspective view of an air-cooling heat exchanger.

Referring now to FIG. 1, a typical air-cooling heat exchanger which is generally designated by the numeral 1 consists of a plurality of fluid receiving and thermally conductive conduits or tubes 10, and heat radiating fins 11, and which are mounted in a given arrangement within a main body or casing 12. The fins 11 extend typically radially, outwardly from the tubes 10 and are affixed to or otherwise made integral with the tubes 10 in such a way so that heat is efficiently transferred from the tubes 10 to the fins. A cooling fluid or refrigerant (not shown) is pumped through the tubes 10 thus cooling them and the affixed radiant fins 11. Thereafter, air from a space to be refrigerated is typically forced over the cooled fins 11 to remove heat from the air. This cooled air is then returned to a refrigerated space (not shown). The heated cooling fluid then releases the heat energy to ambient and then returns to absorb more heat from the air of the refrigerated space until the temperature of the refrigerated space reaches the desired temperature.

Figures 2, 2A:
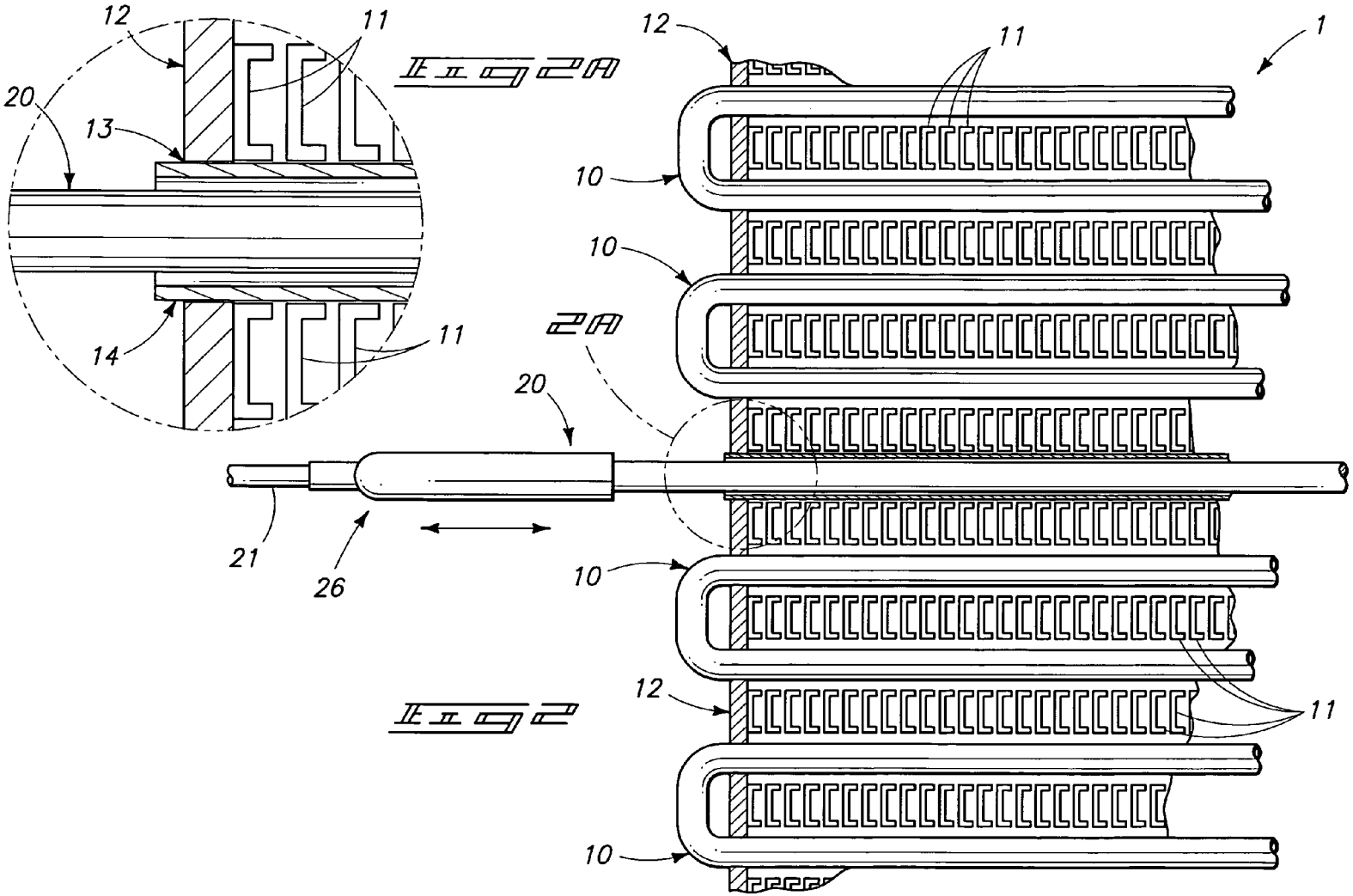
FIG. 2 is a fragmentary, longitudinally, cross-sectional view of a heat exchanger and which illustrates a vacant space which receives a heating element and which is taken from a position along line 2-2 of FIG. 1.

The plurality of tubes 10 are arranged in spaced relation one relative to the others. As presently illustrated, a multiplicity of tubes 10 extend through the heat exchanger. In some arrangements, the tubes may be interconnected or continuous as seen in FIG. 2, and wherein the same conduit may pass through the heat exchanger, more than once. Further, the plurality of radiant fins 11 are shaped to define within the casing 12 a plurality of vacant spaces 13 (FIG. 2) which are located between the respective tubes 10. In one embodiment, the casing 12 will include an aperture 15, that will allow access to a vacant space 13 between the tubes and fins. In other embodiments of the invention, the vacant space may also include a vacant space tube 14 that does not normally conduct a cooling fluid. The vacant space tube 14 which is mounted within the vacant space 13 is typically mounted within the casing 12 such that it may conduct heat energy between it, and the adjacent radiant fins 11. One of ordinarily skill in the art of heat exchanger design will recognize that numerous other configurations of tubes, fins, and vacant spaces are possible, beyond that which is illustrated in the figures.

Referring now to FIG. 2, an electric resistance heating element 20 in accordance with the teachings of the present invention is shown inserted into at least one of the vacant spaces 13 in order to periodically supply heat energy which would be useful in conducting a defrost cycle for the heat exchanger. In this regard, heat from the heating element 20 is supplied to the heat exchanger 1 by way of the thermally conductive fins 11 and tubes 10 to facilitate the melting of frost or ice that has accumulated in unnatural amounts upon those components. The heating element 20 is energized by way of an electrical conduit 21 which is coupled to an AC or DC power source (not shown). A control circuit (not shown) selectively energizes or deenergizes the heating element 20 during predetermined defrost cycles, as described later in this application.

Figure 3:
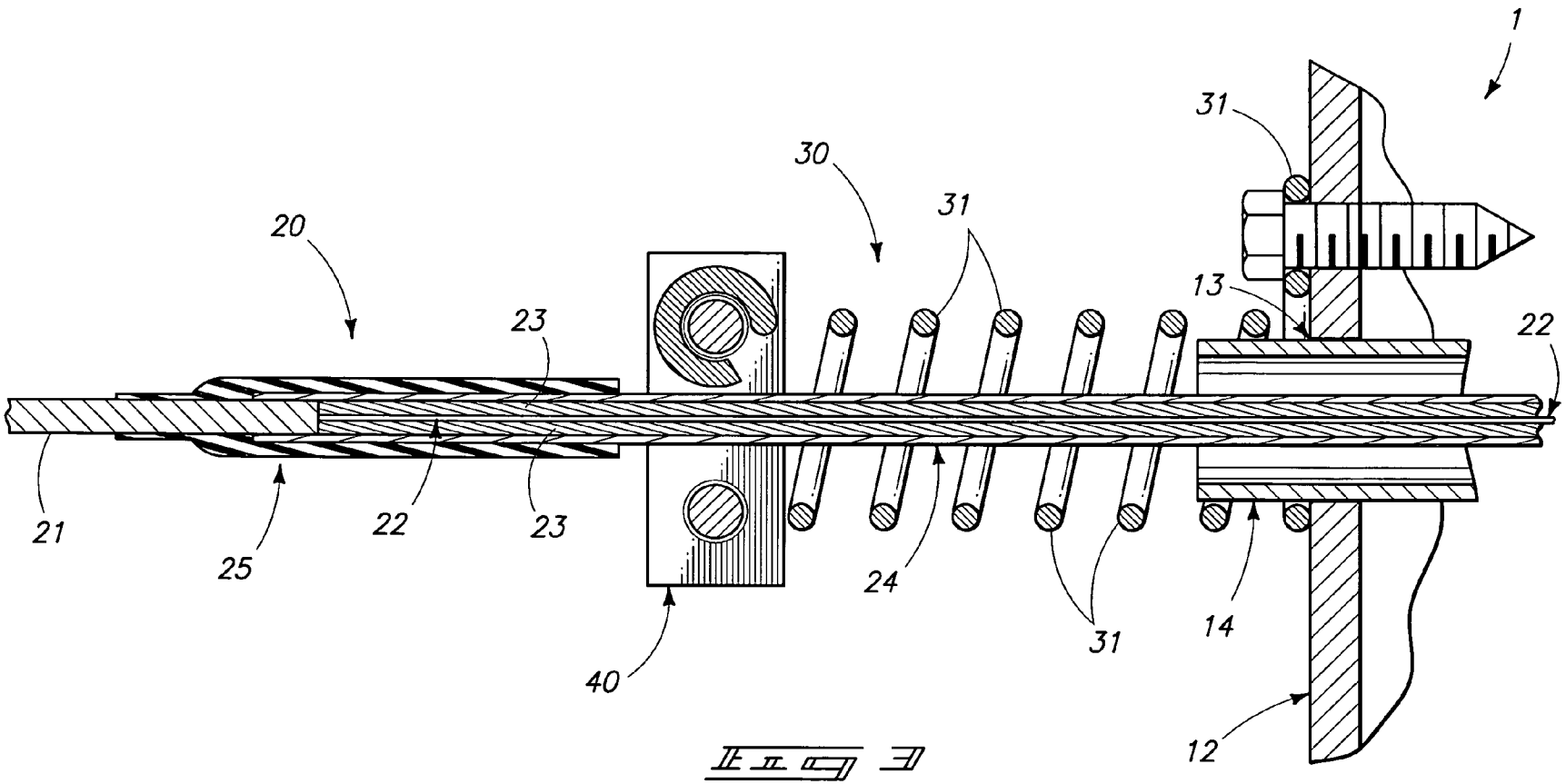
FIG. 3 is a fragmentary, longitudinal, vertical, cross-sectional view of a heating element for a heat exchanger of the present invention and which is taken from a position along line 2-2 of FIG. 2.

Referring now to FIG. 3, the novel electric resistance heating element 20 which forms a feature of the present invention includes a high-resistance filament wire 22, which may be surrounded by a ceramic filler material 23. The ceramic filler material is further surrounded by a metallic sheath 24. The filament wire is electrically connected to the electrical conduit 21, and receives the AC or DC electricity from the external power source (not shown). The electrical connection made between the filament wire 22 and the electrical conduit 21 may be covered by or enclosed within an electrically insulative boot 25 made of a synthetic; flexible membrane; or other flexible, electrically insulating material. In one possible embodiment of the present invention, the heating element 20 provides electrical power from but one end. However, in another form of the invention, the heating element 20 may also be energized from the opposite distal end thereof (not shown). As best illustrated in FIG. 2, one end 26 of the heating element 20 is inserted into the vacant space tube 14 of the heat exchanger 1 such that the electrical conduit 21 and the protective electrical insulating boot 25 protrude outwardly from the vacant space 13, and are otherwise located on the outside of the casing 12 of the heat exchanger 1. The heating element 20 may extend along the entire length of the heat exchanger or along only a portion thereof.

Figure 4:
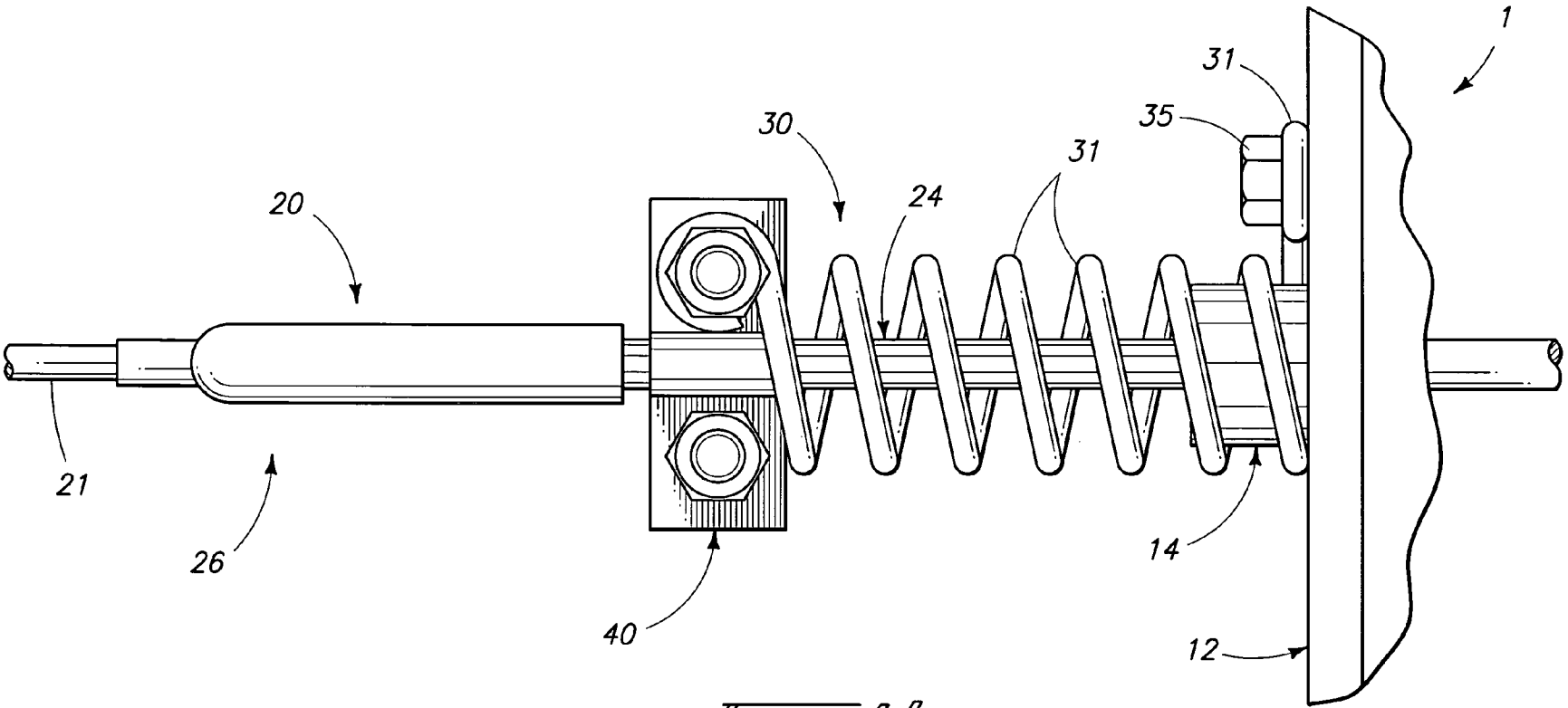
FIG. 4 is a fragmentary, side elevation view of a first embodiment of the present invention.

Referring now to FIG. 4, it will be seen that a biasing member which is generally indicated by the numeral 30 is provided, and which permits limited movement of the heating element 20 relative to the heat exchanger casing 12 during periodic defrost cycles, as explained below. The biasing member 30 is oriented so as to bias the heat element 20 in the direction of the heat exchanger casing 12. In one possible embodiment of the present invention, as shown in FIG. 4, the biasing member 30 comprises a coil spring 31. The coil spring 31 is attached near one end 26 of the heating element 20, in a manner whereby it does not interfere with the electrical connection which is made between the heating element 20 and the electrical conduit 21. In this embodiment, the coil spring 31 is attached to the metal sheath 24 of the heating element 20 by means of a releasable clamp 40 that will be discussed in greater detail, below. In another possible embodiment of the present invention, the biasing member 30 may be affixed to the sheath of the heating element with a ring clamp, a weld, an adhesive, or any other releasable or non-releasable fastener means which has sufficient strength to withstand the forces which are exerted on same. When the coil spring 31 is employed in the present invention, the heating element 20 is telescopingly received, at least in part, within the coil spring. The remaining portion of the heating element 20 may then be inserted into a vacant space tube 14 of the heat exchanger 1 while the coil spring 31 remains outside of the vacant space.

Figure 5:
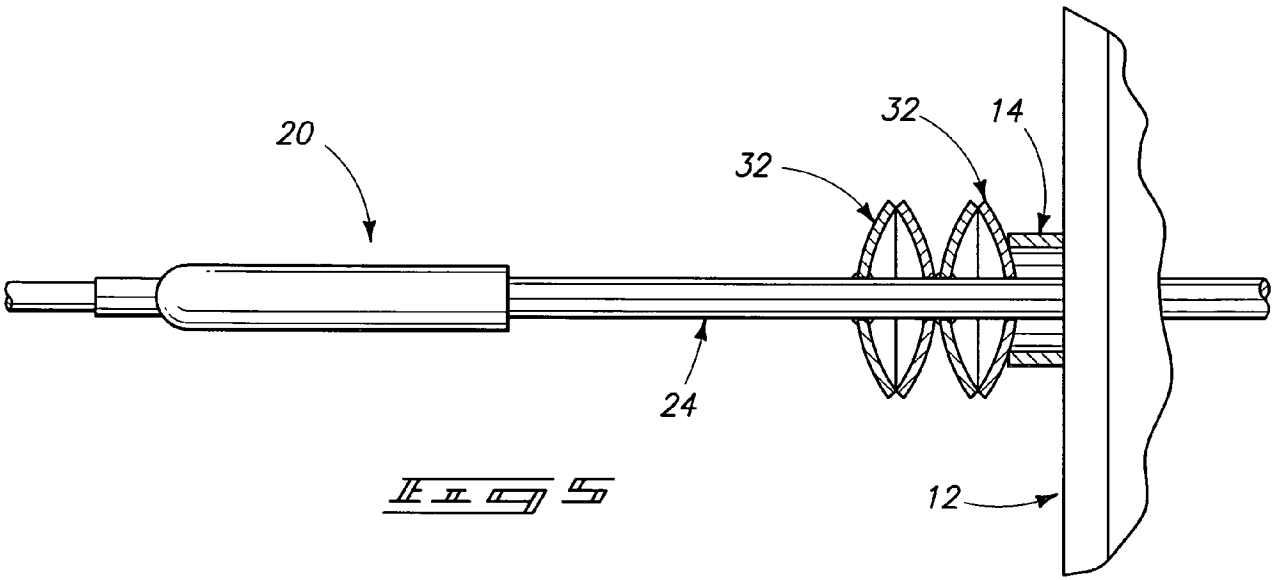
FIG. 5 is a fragmentary, side elevation view of an alternative embodiment of the present invention.
Figure 6:
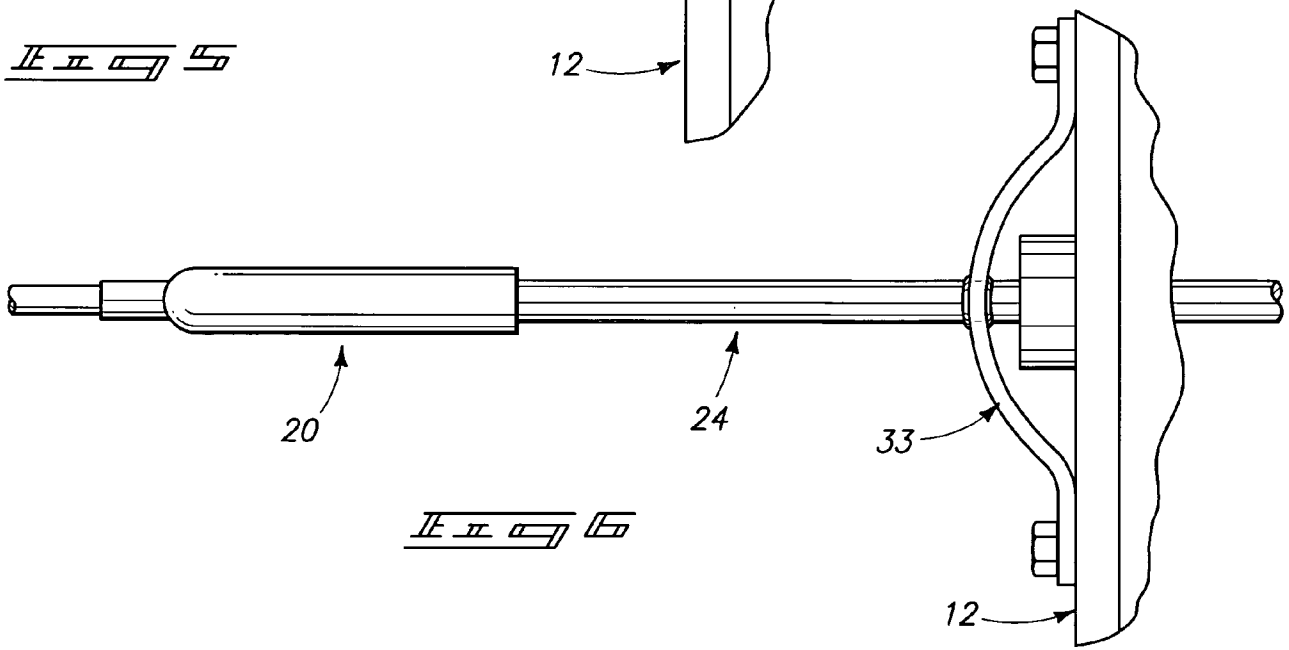
FIG. 6 is a fragmentary, side elevation view of an alternative embodiment of the present invention.
Figure 11:
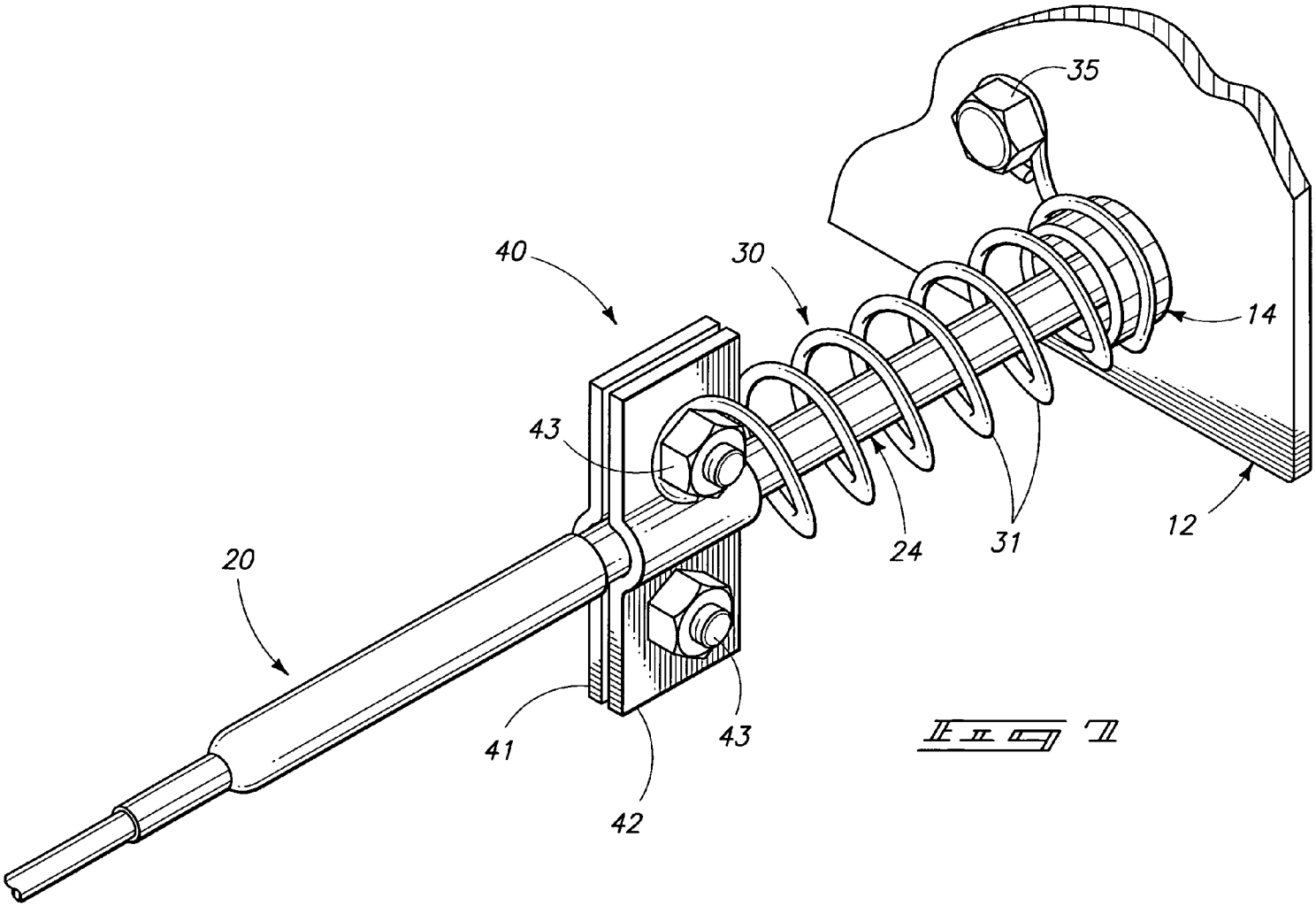

In other embodiments of the present invention, the biasing member 30 may comprise at least one Belleville washer which is generally indicated by the numeral 32 (FIG. 5); a leaf spring 33 (FIG. 6); or any other type of mechanically flexing or biasing member. In all embodiments of the invention, one end of the biasing member 30 is affixed to one end 26 of the heating element 20, and the opposite second end of the biasing member is affixed to the heat exchanger 1, and preferably to either the casing 12, or the outside surface which defines, at least in part, vacant space 13 (FIG. 2A). Still further, it should be understood that the biasing member 30 may be installed such that it may be mounted, in whole or in part, within the casing 12, or as in one embodiment as shown in FIG. 4, it may be mounted entirely outside of the casing. As seen in FIGS. 4 and 7, the coil spring 31 is attached to the heat exchanger casing 12 by a fastener 35. This fastener could include a bolt with a corresponding nut; a machine screw (as illustrated); a cam lock mechanism; an adhesive; or any other conventional fastener or fastening agent.

In the event that the biasing member 30 is fabricated from an electrically conductive material, such as when a metal coil spring 31 is employed, the biasing member 30 will also act as a means to provide an electrical grounding path between the heat exchanger casing 12, and the metal sheath 24 of the heating element 20 (FIG. 3). As should be understood, an electrically continuous ground between the heating element 20 and the heat exchanger is required for safety reasons. Further, if the biasing member 30 is not fabricated from an electrically conductive material, or if any of the means for affixing the biasing member 30 to the heat exchanger casing 12 or the heating element will electrically isolate the casing 12 from the metal sheath 24 of the heating element, then a grounding strap (not shown) must be installed between the casing 12 and the metal sheath 24 to provide an appropriate grounding path.

Referring now to FIG. 7, a means of affixing the coil spring 30 to the heating element 20 is shown. As illustrated therein, a releasable clamp which is generally indicated by the numeral 40 is provided and which consists of first and second members 41 and 42, respectively. As will be appreciated from the drawings, these two members are substantially mirror images of each other. Typically, they are fabricated from metal. The respective members are shaped to receive or otherwise matingly cooperate with the outside surface of the metal sheath 24 of the heating element 20. A close approximation of the shape of the heating element 20 by the releasable clamp 40 is required to insure a secure attachment, and to further facilitate a low-resistance electrical grounding path assuming that the biasing member is electrically conductive. The first and second members 41 and 42 are held together by one or more fasteners 43 of conventional design. As noted earlier, and in other embodiments of the invention, a non-releasable means to affix the coil spring 31 to the heating element 20 may be used. These means may include welds; formed or blind (pop) rivets; adhesive; or other non-releasable fastener means.

OPERATION

The operation of the described embodiments of the present invention are believed to be readily apparent and are briefly summarized at this point.

During normal operation of the air-cooling heat exchanger 1, refrigerant (not shown) is pumped through the heat exchanger tubes 10 while fans (not shown) blow air across the radiant fins 11 so that the refrigerant may extract heat from same. In the operation of the heat exchanger 1, the heating element 20 is normally deenergized. During a subsequent defrost cycle, the following sequence of events typically occurs. As a first matter, the flow of refrigerant to the heat exchanger tubes 10 is stopped. Secondly, the air-cooling fans are turned off once most of the refrigerant has boiled off. Thirdly, the heating elements 20 are energized to a temperature which is normally above 200° F. The heat from the heating elements 20 is then thermally conducted or otherwise transmitted to the heat exchanger's refrigerant tubes 11 and radiating fins 12. During this stage, any frost or ice that has accumulated on these components is melted, and the liquid water is drained from the heat exchanger. Some water, however, inevitably finds its way into some of the regions adjacent to the vacant space tubes 14 in which the heating elements are placed. Fourthly, once all the frost and ice has melted, the heating elements 20 are deenergized. Fifthly, the flow of refrigerant through the heat exchanger tubes 10 is restored and the heat exchanger cools the refrigerant space down to the appropriate temperatures. Finally, in a sixth step, the air-cooling fans are reenergized.

When the heat exchanger begins to cool after the end of a defrost cycle, the water that accumulates, for example, in the vicinity of the vacant space tubes 14 where the heating elements 20 are located will freeze. The resulting ice will conformally and substantially rigidly affix at least a portion of the individual heating elements to the vacant space tube where they rest or are otherwise positioned. During a subsequently conducted defrost cycle, the heating element 20 will heat rapidly, and the metallic sheath 24 will expand as a function of its coefficient of linear expansion. This heating and expansion will typically occur before all the ice that has formed in the vacant spaces 13 and tubes 14 have melted. Since part of the heating element 20 is still anchored to the vacant space tube 14 by the remaining accumulating ice, the heating element will expand outwardly with respect to the heat exchanger casing 12. This outward expansion pressure will then be absorbed by the biasing member 30 without putting undue pressure on the clamp 40 or first and second members 41 and 42, respectively. More importantly, since the biasing member 30 is absorbing the linear expansion forces of the heating element, the heating element itself will not typically be damaged. Further, internal damage which might be caused to the heat exchanger tubes or fins by the expanding heat element 20 is substantially impeded.

Once the defrost cycle nears completion, the ice that has anchored the heating element 20 to the vacant space tube 14 eventually melts as well. As this anchoring ice melts, the biasing element 30 then returns the heating element 20 back to its original position, thus preventing the heating element from "creeping" or "walking" out of the heat exchanger 1. This, of course, further prevents damage to the heating element wiring and any neighboring equipment.

In compliance with the statute, the invention has been described in language more or less specific as to structural and methodical features. It is to be understood, however; that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A heat exchanger comprising:

a main body which supports a fluid receiving conduit;

a heating element which expands when energized, and contracts when deenergized and which is positioned within a vacant space defined by the main body of heat exchanger, and further is disposed in heat transmitting relation relative to the fluid receiving conduit, and wherein the heating element has a first end which is located in spaced relation relative to the main body of the heat exchanger, and an opposite second end which is located within the vacant space; and a coil spring having a first end which is affixed to the first end of the heating element, and a second end which is affixed to the main body of the heat exchanger, and wherein the first end of the heating element is telescopingly received within the coil spring, and wherein the coil spring is placed into tension when the heating element is energized and then expands.

2. A heat exchanger as claimed in claim 1, and further comprising a releasable clamp affixed near the first end of the heating element, and wherein the first end of the coil spring is affixed to the releasable clamp.

3. A heat exchanger as claimed in claim 2, and wherein the releasable clamp comprises a first member and an opposite mirror image second member, and wherein the first and second members are juxtaposed in opposing orientation to form a receiving station for receiving the heating element; and wherein the releasable clamp further comprises means for fixedly retaining the first and second members together so as to affix the clamp to the heating element, and means for fixedly retaining the coil spring to one of the first or second members.

4. A heat exchanger comprising:

a casing which defines, at least in part, a vacant space;

a fluid receiving conduit mounted on the casing and which defines, at least in part, the vacant space;

a heat radiating fin mounted on the fluid receiving conduit, and extending outwardly relative thereto and into the vacant space;

a heating element having a main body with opposite first and second ends, and wherein the main body is received within the vacant space, and disposed in juxtaposed thermal transmitting relation relative to the fluid receiving conduit and the heat radiating fin; and a coil spring having a first end which is affixed to the first end of the heating element, and which positions the first end of the heating element in spaced relation relative to the casing, and a second end which is fixed to the casing, and wherein the coil spring is in neither compression or tension when the heating element is in a deenergized state, and is further placed into tension when the heating element is energized.

5. A method for defrosting an air cooling heat exchanger, comprising:

providing a casing;

providing a plurality of fluid receiving conduits and a plurality of heat radiating fins mounted on the fluid receiving conduits, and wherein the fins are oriented in thermal radiating relation relative to the plurality of fluid receiving conduits;

providing a heating element and orienting the heating element in thermal transmitting relation relative to the plurality of fluid receiving conduits and the plurality of heat radiating fins;

energizing the heating element to a temperature over 200° F. so as to facilitate the heating of the plurality of conduits and fins;

deenergizing the heating element, then cooling the plurality of conduits and fins to a temperature below about 32° F.;

providing a single coil spring and mounting the single coil spring to each of the casing and the individual heating element; and resiliently restraining the heating element relative to the casing by placing the single coil spring into tension so as to oppose longitudinal outward movement of the heating element relative to the casing during the energizing and deenergizing of the heating element.

6. A heat exchanger, comprising:

an air cooling heat exchanger defining an internally disposed vacant space, and which further has a fluid receiving conduit which is located within the vacant space;

an elongated heating element which when energized generates heat energy and gets longer in length, and further when deenergized contracts to a given shorter length, and wherein the heating element has a main body which is disposed in the vacant space defined by the air cooling heat exchanger, and further is located in heat transferring relation relative to the fluid receiving conduit, and wherein the heating element has a first end which is located outside of the air cooling heat exchanger, and an opposite second, distal end, which is located within the vacant space and disposed in heat transferring relation relative to the fluid receiving conduit; and a coil spring having a first, and an opposite second end, and wherein the first end of the heating element is received internally of the coil spring, and the first end of the coil spring is fastened to the first end of the heating element, and the second end of the coil spring is fastened to the air cooling heat exchanger, and wherein, in the deenergized state of the heating element, the coil spring is substantially uncompressed, and further positions the first end of the heating element in a predetermined spaced relationship relative to the air cooling heat exchanger, and wherein the air cooling heat exchanger, when rendered operational, causes ice to form about the fluid receiving conduit and the main body of the heating element, and wherein upon energizing the heating element to melt the ice which has formed about the fluid receiving conduit and the main body of the heating element, the heating element generates heat energy and further increases in length in a manner whereby the first end of the heating element moves outwardly relative to the air cooling heat exchanger, and places the coil spring into tension, and wherein upon melting the ice which had formed within the air cooling heat exchanger, the coil spring which had previously been placed into tension contracts and returns the first end of the heating element to the predetermined spaced relationship the first end of the heating element had relative to the air cooling heat exchanger when the heating element was deenergized.

* * * * *